United States Patent [19]

Tsukamoto et al.

[11] Patent Number: 4,768,583

[45] Date of Patent: Sep. 6, 1988

[54] HEAT EXCHANGER WITH CORRUGATED HEAT TRANSFER PLATES

[75] Inventors: Ikuo Tsukamoto; Kiyoshi Sakuma; Yoshiaki Tanimura; Hiroyuki Umemura, all of Shizuoka; Yu Seshimo; Masao Fujii, both of Amagasaki; Makoto Yamada, Shizuoka, all of Japan

[73] Assignee: Mitsubishi Denki Kabushiki Kaisha, Tokyo, Japan

[21] Appl. No.: 860,623

[22] Filed: May 6, 1986

[30] Foreign Application Priority Data

May 24, 1985 [JP] Japan ..... 60-77305[U]
May 24, 1985 [JP] Japan ..... 60-77306[U]

[51] Int. Cl.[4] ..... F28B 1/00; F25D 21/14

[52] U.S. Cl. ..... 165/110; 165/913; 62/285; 62/290

[58] Field of Search ..... 165/110, 913; 62/285, 62/286, 290

[56] References Cited

U.S. PATENT DOCUMENTS

| | | | |
|---|---|---|---|
| 2,586,399 | 2/1952 | Vewt | 165/110 X |
| 2,638,757 | 5/1953 | Borgerd | 62/285 |
| 3,837,396 | 9/1974 | Newton | 165/913 X |
| 4,180,129 | 12/1979 | Sumitomo | 165/166 |

FOREIGN PATENT DOCUMENTS

| | | | |
|---|---|---|---|
| 123949 | 7/1931 | Fed. Rep. of Germany | 165/913 |
| 2708658 | 9/1977 | Fed. Rep. of Germany | 165/110 |
| 55-33889 | 10/1981 | Japan | 62/285 |
| 58-150731 | 9/1983 | Japan | 62/285 |
| 61-143697 | 7/1986 | Japan . | |

OTHER PUBLICATIONS

Chu et al., Vapor Proof Venting Valve, 3-68.

*Primary Examiner*—Ira S. Lazarus
*Assistant Examiner*—Richard R. Cole
*Attorney, Agent, or Firm*—Lowe, Price, LeBlanc, Becker & Shur

[57] ABSTRACT

A heat exchanger comprises a plurality of perforated and regularly corrugated heat transfer plates arranged in a ridge-to-ridge and furrow-to-furrow arrangement, so as to form primary fluid passages each consisting of alternate expanded sections and narrowed sections arranged along the direction of flow of a primary fluid, and a plurality of pipes for passing a secondary fluid therethrough, the pipes penetrating through and across the heat transfer plates. Oblique guide grooves are formed in the surfaces of each heat transfer plates to facilitate the downward flow of the condensate condensed over the surfaces of the heat transfer plates, the grooves being inclined closer to the vertical than to the horizontal to facilitate downward flow of any vapor condensed on the plates from the primary fluid whereby the heat transfer plates dry quickly for efficient heat exchange between the primary and secondary fluids.

2 Claims, 4 Drawing Sheets

A : Primary fluid

A1: A2: } Separate primary fluid passages

1a: 1b: 1c: } Heat transfer plates

2 : Through holes

3 : Oblique walls

4 : Expanded sections

5 : Narrowed sections

6 : Pipes

7 : Guide grooves

B : Secondary fluid

PRIOR ART

HEAT EXCHANGER WITH CORRUGATED HEAT TRANSFER PLATES

BACKGROUND OF THE INVENTION

The present invention relates generally to a heat exchanger and, more specifically, to an improved heat exchanger having a plurality of substantially parallel heat transfer plates arranged side by side at fixed intervals and each formed so as to facilitate the flow of the condensate condensed over the surface thereof along the same.

A conventional heat exchanger disclosed in Japanese Patent Application, Preliminary Publication No. 61-143697, is shown in FIGS. 6 and 7. Referring to FIGS. 6 and 7, heat transfer plates 1*a*, 1*b* and 1*c* each having a plurality of through holes 2 are arranged in parallel to each other at fixed intervals so as to form separate primary fluid passages $A_1$ and $A_2$ for passing a primary fluid A therethrough; the heat transfer plates 1*a*, 1*b* and 1*c* are corrugated regularly to form oblique walls 3; the primary fluid passages $A_1$ and $A_2$ each has alternate expanded sections 4 and narrowed sections 5; the heat transfer plates 1*a*, 1*b* and 1*c* are arranged side by side so that the expanded sections 4 and the narrowed sections 5 of the primary fluid passage $A_1$ correspond to the narrowed sections 5 and the expanded sections 4 of the adjacent primary fluid passage $A_2$, respectively; and pipes 6 for passing a secondary fluid which exchanges heat with the primary fluid therethrough penetrate through alternate lateral arrangements of the expanded sections 4 and the narrowed sections formed alternately between the heat transfer plates 1*a*, 1*b* and 1*c*.

When the primary fluid A flows through the primary fluid passages $A_1$ and $A_2$, the dynamic pressure, hence also the static pressure, of the primary fluid A varies alternately, namely, the dynamic pressure increases and the static pressure decreases in the narrowed sections 5, while the dynamic pressure decreases and the static pressure increases in the expanded sections 4. Consequently, part of the primary fluid A flows through the through holes 2 from the expanded sections 4 of the primary fluid passages $A_1$ and $A_2$ into the narrowed sections of the primary fluid passages $A_2$ and $A_1$, respectively, as indicated by arrows in FIG. 6, while the general direction of flow of the primary fluid A remains unchanged. This flow of part of the primary fluid A through the through holes 2 between the adjacent primary fluid passages $A_1$ and $A_2$ reduces the thickness of so-called temperature boundary layers that develop over the surfaces of the heat transfer plates 1*a*, 1*b* and 1*c*, which enhances the heat transfer coefficient of the heat exchanger greatly.

When the thus constructed heat exchanger is applied to an apparatus which is operated in a low temperature range, such as a refrigerator, and the temperature difference between the primary fluid and the secondary fluid which exchange heat with each other through the heat transfer plates 1*a*, 1*b* and 1*c* is large, or when the primary fluid which flows through the primary fluid passages is humid, the surfaces of the heat transfer plates 1*a*, 1*b* and 1*c* and the pipes 6 for passing the secondary fluid B become frosted. Consequently, the frost deteriorates the efficiency of heat exchange between the primary fluid and the heat transfer plates and between the primary fluid and the pipes, and narrows the primary fluid passages $A_1$ and $A_2$ formed between the heat transfer plates 1*a*, 1*b* and 1*c* to impede the flow of the primary fluid A, and thereby the heat exchanging efficiency of the heat exchanger deteriorates greatly. On the other hand, in some apparatus employing the heat exchanger, such as a refrigerator, the heat transfer plates and the pipes are heated periodically with a heater to remove the frost covering the surfaces of the heat transfer plates and the pipes of the heat exchanger. However, such an apparatus has a drawback that the water produced by defrosting the heat transfer plates and the pipes refreezes as ice over the surfaces of the heat transfer plates and the pipes.

SUMMARY OF THE INVENTION

Accordingly, it is an object of the present invention to provide a heat exchanger having improved heat transfer plates capable of facilitating the flow of the water condensate covering the surfaces of the heat transfer plates and the pipes along the same so that the surfaces of the heat transfer plates and the pipes are dried quickly to prevent the reicing of the water condensate.

According to one aspect of the present invention, guide grooves are formed in the surfaces of the heat transfer plates to facilitate the downward flow of the water condensate condensed over the surfaces of the heat transfer plates and the pipes for passing the secondary fluid therethrough.

According to another aspect of the present invention, the heat transfer plates are corrugated so that oblique walls declining from one side edge to the other side edge of each heat transfer plate are formed. The thus declined oblique walls inhibit the water condensate staying over the surfaces of the oblique walls and enhances the drying capability of the heat transfer plates.

The above and other objects, features and advantages of the present invention will become more apparent from the following description of the preferred embodiments thereof taken in conjunction with the accompanying drawings.

DESCRIPTION OF THE PREFERRED EMBODIMENTS

Figure 1:
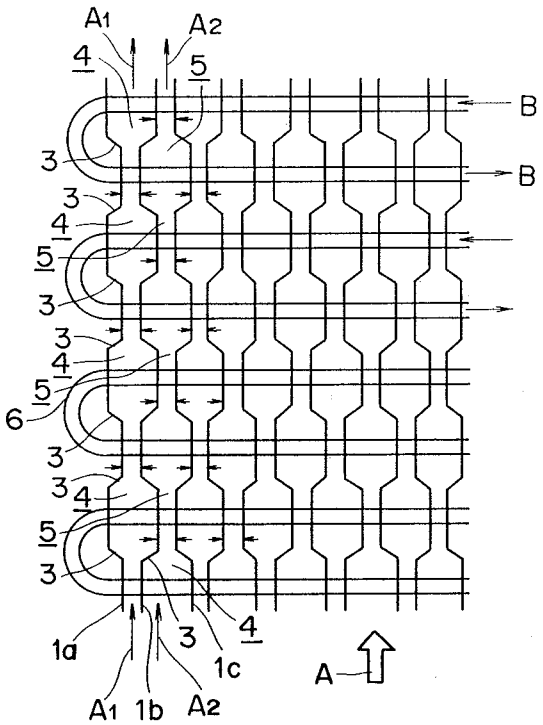
FIG. 1 is a front elevation of a heat exchanger, in a first embodiment, according to the present invention.
Figure 5:
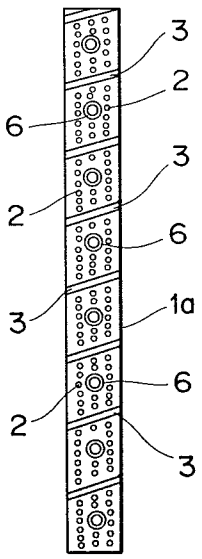
FIG. 5 is a sectional side elevation of the heat exchanger of FIG. 4.
Figure 3:
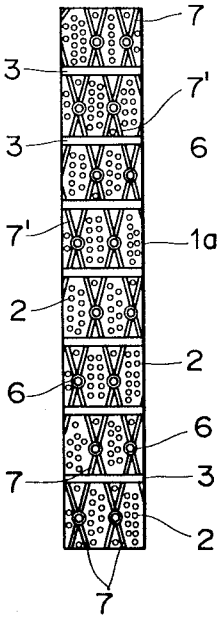
FIG. 3 is a sectional side elevation, similar to FIG. 2, of a heat exchanger, in a second embodiment, according to the present invention.
Figure 7:
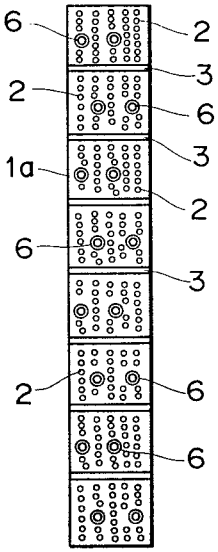
FIG. 7 is a sectional side elevation of the conventional heat exchanger of FIG. 6.
Figure 6:
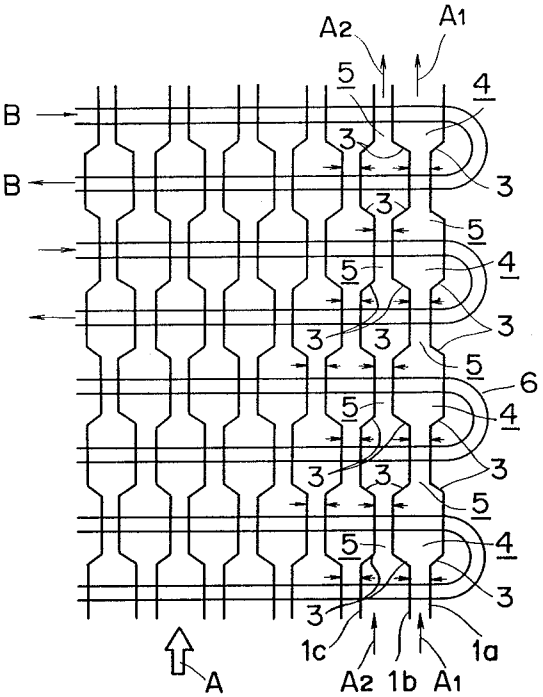
PRIOR ART FIG. 6
FIG. 6 is a front elevation of a conventional heat exchanger.

In FIGS. 1 to 7, like reference characters and reference numerals designate like or corresponding parts throughout, and the description of the components and constitution of the embodiments of the present invention which are the same as the conventional heat exchanger described hereinbefore with reference to FIGS. 6 and 7 will be omitted to avoid duplication.

Figure 2:
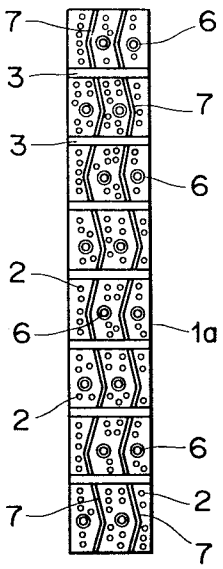
FIG. 2 is a sectional side elevation of the heat exchanger of FIG. 1.

In a first embodiment of the present invention, a plurality of zigzag guide grooves 7 for guiding the water condensate downward are formed in the surfaces of heat transfer plates 1*a*, 1*b* and 1*c* so as to extend clear of through holes 2 formed in the heat transfer plates 1*a*, 1*b* and 1*c*, from the upper edge to the lower edge of each heat transfer plates as illustrated in FIG. 2.

In a second embodiment of the present invention, a plurality of right oblique guide grooves 7 declining to the right and a plurality of left oblique guide grooves 7' declining to the left are formed in the surfaces of heat transfer plates 1*a*, 1*b* and 1*c* so as to intersect each other at pipes 6 through which the secondary fluid B flows. These oblique guide grooves 7 and 7' collect and guide downward the condensate condensed over the surfaces of the pipes 6 as well as the condensate condensed over the surfaces of the heat transfer plates 1*a*, 1*b* and 1*c*. The constitution of the heat exchanger in the second embodiment is the same as that in the first embodiment except for the configuration of the guide grooves.

The guide grooves 7 and 7' of the heat exchangers according to the present invention facilitate the downward flow of the water condensate condensed over the surfaces of the heat transfer plates 1*a*, 1*b* and 1*c* and the pipes 6 and the water produced when the heat exchangers are defrosted, so that the heat transfer plates 1*a*, 1*b* and 1*c* and the pipes 6 are dried quickly, and thereby heat exchange between the primary fluid and the secondary fluid is achieved efficiently through the heat transfer plates.

Figure 4:
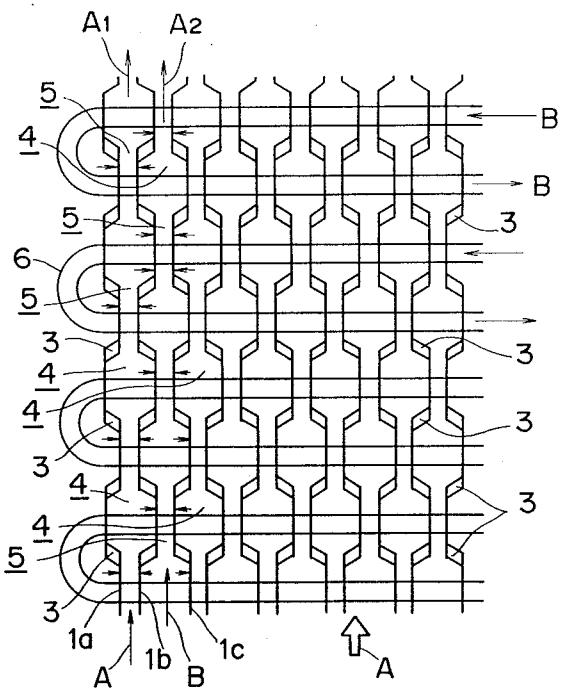
FIG. 4 is a front elevation of a heat exchanger, in a third embodiment, according to the present invention.

Referring to FIGS. 4 and 5, in a third embodiment of the present invention, heat transfer plates 1*a*, 1*b* and 1*c* are corrugated regularly and arranged side by side similarly to those of the first and second embodiments. However, in the third embodiment, each heat transfer plate has oblique walls 3 inclining at an angle to the direction of flow of the primary fluid and declining from one side edge to the other side edge of the heat transfer plate. Therefore, the water condensate condensed over the surfaces of the heat transfer plates 1*a*, 1*b* and 1*c* and the pipes 6 is unable to stay over the oblique walls in flowing downward and flows obliquely downward along the oblique walls, whereby the heat transfer plate 1*a*, 1*b* and 1*c* are made to dry quickly.

As apparent from the foregoing description, according to the present invention, the guide grooves formed in the surfaces of the heat transfer plates or the oblique walls of the corrugated heat transfer plates facilitate the downward flow of the water condensate condensed over the surfaces of the heat transfer plates and the pipes of the heat exchanger, and thereby the heat transfer plates are made to dry quickly, and hence the heat exchanging efficiency of the heat exchanger is enhanced. Accordingly, the heat exchanger according to the present invention is effectively applicable to apparatus in which temperature difference between the primary fluid and the secondary fluid is large, such as refrigerators, and to apparatus in which the heat exchanger is exposed to a humid primary fluid.

Although the invention has been described in its preferred embodiments with a certain degree of particularity, it is to be understood that many variations and changes are possible in the invention without departing from the scope and spirit thereof.

What is claimed is:

1. A heat exchanger, comprising:

a plurality of perforated and regularly corrugated heat transfer plates, arranged in a ridge-to-ridge and furrow-to-furrow arrangement so as to form primary fluid passages between adjacent plates, each said passage consisting of alternate expanded sections and narrowed sections arranged along the principal direction of flow of a primary fluid including a condensable vapor component; and a plurality of pipes for passing a secondary fluid therethrough, said pipes penetrating through and across the heat transfer plates;

said heat transfer plates each having a plurality of zigzag guide grooves formed so as to extend clear of the perforations, the grooves being inclined closer to the vertical than to the horizontal to facilitate rapid downward flow of the condensate of said vapor condensed on said plate surfaces, the grooves being deployed from the uppermost to the lowermost portions of said plates to provide substantially continuous paths to the condensate flow.

2. A heat exchanger, comprising:

a plurality of perforated and regularly corrugated heat transfer plates, arranged in a ridge-to-ridge and furrow-to-furrow arrangement so as to form primary fluid passages between adjacent plates, each said passage consisting of alternate expanded sections and narrowed sections arranged along the principal direction of flow of a primary fluid including a condensable vapor component; and a plurality of pipes for passing a secondary fluid therethrough, said pipes penetrating through and across the heat transfer plates;

said heat transfer plates each having a plurality of right oblique guide grooves declining to the right and a plurality of left oblique guide grooves declining to the left, so that said grooves intersect each other at the pipes, the grooves being inclined closer to the vertical than to the horizontal to facilitate rapid downward flow of the condensate of said vapor condensed on said plate surfaces, and over the surfaces of the pipes, the grooves being deployed from the uppermost to the lowermost portions of said plates to provide substantially continuous paths to the condensate flow.

* * * * *